US008251033B2

(12) United States Patent
Yager et al.

(10) Patent No.: US 8,251,033 B2
(45) Date of Patent: Aug. 28, 2012

(54) SYSTEM AND METHOD FOR VARYING A DURATION OF A CLOSING PHASE OF AN INTAKE VALVE OF AN ENGINE

(75) Inventors: James Yager, North East, PA (US); Paul Flynn, Fairview, PA (US)

(73) Assignee: General Electric Company, Schenectady, NY (US)

( * ) Notice: Subject to any disclaimer, the term of this patent is extended or adjusted under 35 U.S.C. 154(b) by 561 days.

(21) Appl. No.: 12/276,612

(22) Filed: Nov. 24, 2008

(65) Prior Publication Data

US 2010/0126444 A1 May 27, 2010

(51) Int. Cl.
*F01L 1/14* (2006.01)

(52) U.S. Cl. ..... 123/90.48; 123/90.16; 123/90.52

(58) Field of Classification Search ..... 123/90.16, 123/90.48, 90.52, 90.12
See application file for complete search history.

(56) References Cited

U.S. PATENT DOCUMENTS

| | | | | |
|---|---|---|---|---|
| 5,327,858 | A * | 7/1994 | Hausknecht | 123/90.12 |
| 5,327,860 | A | 7/1994 | Kruger | |
| 5,515,821 | A | 5/1996 | Wolck, Jr. | |
| 5,727,509 | A | 3/1998 | Speil | |
| 6,321,723 | B1 | 11/2001 | Merkle et al. | |
| 6,553,950 | B2 | 4/2003 | Chiappini et al. | |
| 6,990,935 | B2 | 1/2006 | Simpson | |

* cited by examiner

*Primary Examiner* — Zelalem Eshete
(74) *Attorney, Agent, or Firm* — GE Global Patent Operation; John A. Kramer

(57) ABSTRACT

A system is provided for varying a duration of a closing phase of an intake valve of an engine. The system includes a tappet assembly coupled to the intake valve, where the tappet assembly includes a first tappet body and a second tappet body within a guide housing. The system also includes a cam coupled to the main shaft. The cam engages the tappet assembly to initiate the relative oscillation of the first tappet body to the second tappet body. The system also includes a hydraulic piston positioned within the guide housing and coupled to the first tappet body. The hydraulic piston selectively varies a duration of the relative oscillation of the first tappet body to the second tappet body based upon a parameter of a hydraulic fluid supplied to the hydraulic piston, to selectively vary the duration of the closing phase of the intake valve.

11 Claims, 8 Drawing Sheets

SYSTEM AND METHOD FOR VARYING A DURATION OF A CLOSING PHASE OF AN INTAKE VALVE OF AN ENGINE

BACKGROUND OF THE INVENTION

This invention relates to an intake valve for an engine and, more particularly, to a system and method for controlling the intake valve of an engine.

Internal combustion engines, such as a pushrod engine (overhead valve engine), for example, feature an intake valve that is coupled to a rotating cam through a valve train. Based on the rotation of the cam, the intake valve oscillates between an opening phase, during which an opening is formed to provide air (or an air/gas mixture) to a cylindrical cavity, and a closing phase, during which the opening is closed. In conventional internal combustion engines, the duration of the closing phase concludes based on a piston being positioned at a bottom portion of the cylindrical cavity. However, various operating parameters of the engine, such as a load, for example, determine an optimal duration of the closing phase, in order to optimize a performance characteristic of the engine, such as fuel efficiency and emissions, for example.

Conventional engine systems have been proposed to vary the duration of the closing phase during various operating phases of the engine (or upon the occurrence of one or more designated engine operating parameters), but these systems have several shortcomings. For example, these conventional engine systems do not facilitate a smooth transition between the various durations of the closed phase, as the operating parameters of the engine vary. Thus, optimization of the duration of the closing phase, based on the performance characteristics of the engine, is not often realized.

BRIEF DESCRIPTION OF THE INVENTION

One embodiment of the present invention provides a system for varying a duration of a closing phase of an intake valve of an engine. The engine includes an engine piston coupled to a main shaft. The piston oscillates within a cylinder from a top portion to a bottom portion. The intake valve is positioned adjacent to the cylinder, and oscillates between an opening phase, during which an opening is formed to permit a passage of air into the cylinder, to the closing phase, during which the opening is closed to prevent the passage of air into the cylinder. The system includes a tappet assembly coupled to the intake valve, where the tappet assembly includes a first tappet body and a second tappet body within a guide housing. The oscillation of the intake valve between the opening phase and the closing phase is based on a relative oscillation of the first tappet body and the second tappet body within the guide housing. The system also includes a cam coupled to the main shaft. The cam engages the tappet assembly to initiate the relative oscillation of the first tappet body to the second tappet body. The system also includes a hydraulic piston positioned within the guide housing and coupled to the first tappet body. The hydraulic piston selectively varies a duration of the relative oscillation of the first tappet body to the second tappet body based upon a parameter of a hydraulic fluid supplied to the hydraulic piston, to selectively vary the duration of the closing phase of the intake valve.

Another embodiment of the present invention provides a system for varying a duration of a closing phase of an intake valve of an engine. The system includes a tappet assembly coupled to the intake valve. The tappet assembly includes a first tappet body and a second tappet body within a guide housing. The duration of the closing phase is based on a relative oscillation of the first tappet body and the second tappet body within the guide housing. The system includes a cam being engaged with the tappet assembly to initiate the relative oscillation of the first tappet body to the second tappet body. The system further includes a hydraulic piston positioned within the guide housing and coupled to the first tappet body. The hydraulic piston selectively varies a duration of the relative oscillation of the first tappet body to the second tappet body based on a parameter of a hydraulic fluid supplied to the hydraulic piston, to selectively vary the duration of the closing phase of the intake valve.

Another embodiment of the present invention provides a method for varying a duration of a closing phase of an intake valve of an engine. The engine includes an engine piston coupled to a main shaft. The piston oscillates within a cylinder from a top portion to a bottom portion. The intake valve is positioned adjacent to the cylinder, and oscillates between an opening phase, during which an opening is formed to permit a passage of air into the cylinder, to the closing phase, during which the opening is closed to prevent the passage of air into the cylinder. The method includes engaging the tappet assembly with a cam, where the tappet assembly includes a first tappet body and a second tappet body positioned within a guide housing and a hydraulic piston positioned within the guide housing. The method further includes initiating a relative oscillation of the first tappet body to the second tappet body, where the duration of the closing phase is based upon the relative oscillation. The method further includes supplying the hydraulic piston with a hydraulic fluid during the closing phase, where a selective parameter of the hydraulic fluid is based on a parameter of the engine. The method further includes selectively varying the relative oscillation and the duration of the closing phase based upon the supplying the hydraulic piston with the hydraulic fluid.

Another embodiment of the present invention provides a method for controlling an intake valve of an engine. The engine includes an engine piston configured to oscillate within a cylinder from a top portion to a bottom portion. The intake valve is positioned adjacent to the cylinder, and oscillates between an opening phase and a closing phase. The method includes engaging a tappet assembly with a cam to initiate a relative oscillation of a first tappet body to a second tappet body. The tappet assembly is operably connected to the intake valve, a duration of the intake valve closing phase is based upon the relative oscillation, and the tappet assembly includes a guide housing and the first tappet body and the second tappet body are positioned within the guide housing. During the closing phase, the method further includes supplying a hydraulic fluid to a hydraulic piston positioned within the guide housing, where a rate of the relative oscillation, and thus the duration of the closing phase, is a function of a parameter of the hydraulic fluid.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
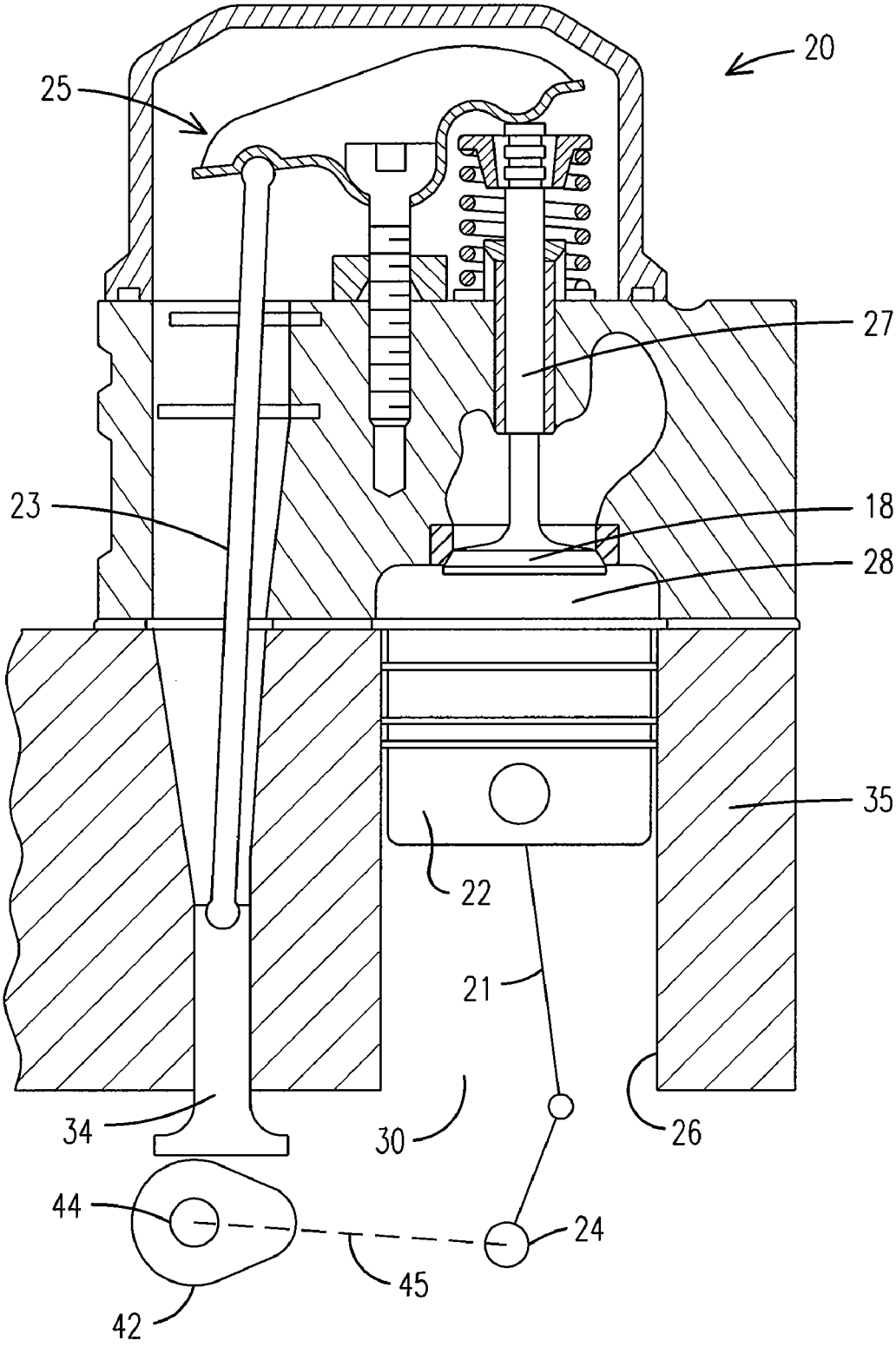
FIG. 1 is a cross-sectional side view of an exemplary embodiment of an engine within a system for varying a duration of a closing phase of an intake valve of an engine.

Reference will now be made in detail to the embodiments consistent with the invention, examples of which are illustrated in the accompanying drawings. Wherever possible, the same reference numerals used throughout the drawings refer to the same or like parts.

FIG. 1 illustrates an engine 20 according to an embodiment of the present invention. In an exemplary embodiment, the engine may be a pushrod engine, but may have an alternate structure, such as an overhead cam design, for example. Additionally, the engine 20 may be utilized in a powered system, such as a locomotive or other rail vehicle, an off-highway vehicle, a transport vehicle, and/or a marine vehicle/vessel, for example.

The engine 20 includes an engine piston 22 coupled by a link 21 to a rotating main shaft 24. Based on the rotatable coupling with the main shaft 24, the piston 22 oscillates within a cylinder 26 from a top portion 28 to a bottom portion 30 of the cylinder 26, during a cycle of the engine 20. The cylinder 26 is formed in an engine block portion 35 of the engine, e.g., the engine block may be a machined, metal casting having a plurality of cylinders formed therein. An intake valve 18 is positioned adjacent to the top portion 28 of the cylinder 26, and oscillates between an opening phase 14 (FIG. 7), during which an opening is formed to permit a passage of air (or air/fuel mixture) into the cylinder 26 (above the piston 22), and a closing phase 12 (FIG. 8), during which the opening is closed to prevent the passage of air into the cylinder 26. As further illustrated in FIG. 1, a cam 42 is coupled to a cam shaft 44, and the cam shaft 44 is linked at 45 to the main shaft 24. As described in further detail below, the cam 42 engages a tappet assembly 34, which in-turn causes the intake valve 18 to oscillate between the opening phase 14 and the closing phase 12. The tappet assembly 34 is operably coupled to the intake valve 18 through a valve train including a pushrod 23, a rocker arm 25, and a valve stem 27, which collectively cause the intake valve 18 to oscillate between the opening phase 14 and the closing phase 12, in response to the rotatable engagement of the cam 42 with the tappet assembly 34.

Figure 2:
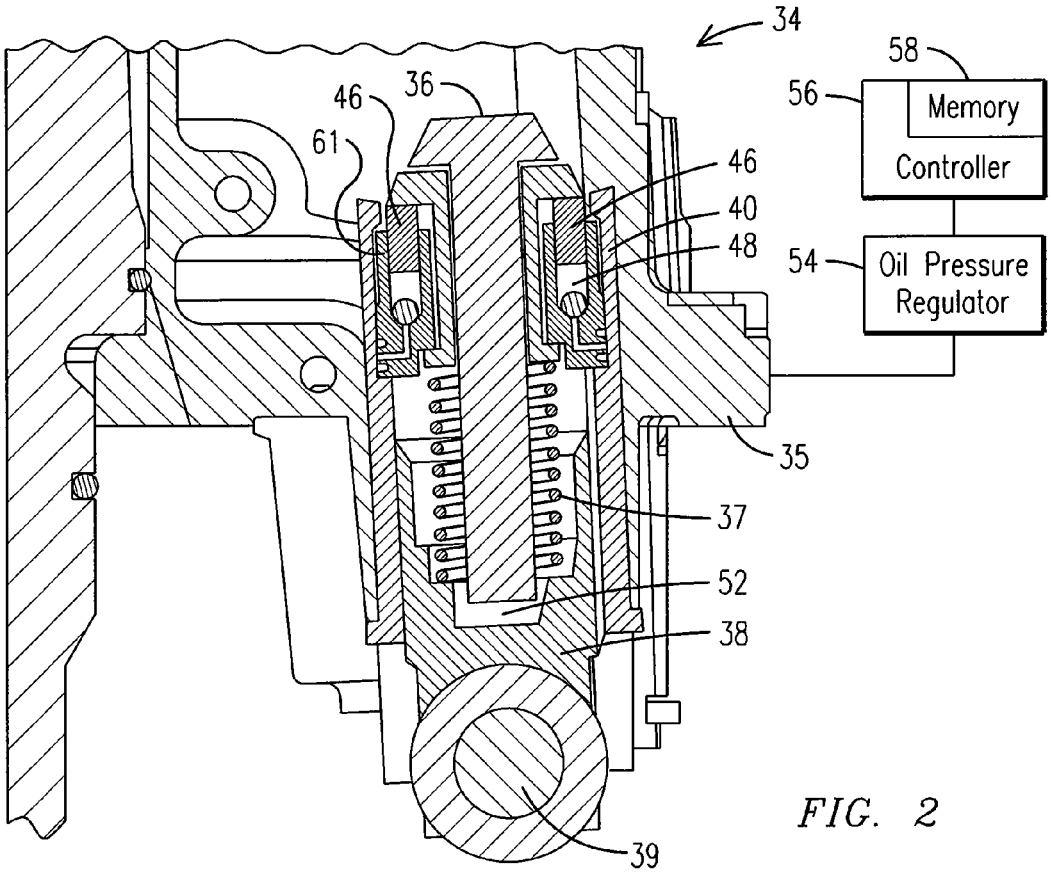
FIG. 2 is a cross-sectional side view of an exemplary embodiment of the system for varying a duration of a closing phase of an intake valve of an engine.

FIG. 2 illustrates the tappet assembly 34 according to an embodiment of the present invention. The tappet assembly 34 includes a first tappet body or an upper tappet body 36 and a second tappet body or a lower tappet body 38, where the upper and lower tappet bodies 36,38 are positioned within a guide housing 40. The oscillation of the intake valve 18 between the opening phase 14 and the closing phase 12 is based on a relative oscillation of the upper tappet body 36 and the lower tappet body 38 within the guide housing 40. As discussed above, the cam 42 engages the tappet assembly 34, and more specifically, the cam 42 engages a cam roller 39 coupled to the lower tappet body 38, to initiate the relative oscillation of the upper tappet body 36 to the lower tappet body 38. A spring 37 is positioned within the guide housing 40 between the upper and lower tappet bodies 36,38. The upper tappet body 36 is passed through an opening in the spring 37, and thus the spring 37 assists in the relative oscillation of the upper and lower tappet bodies 36,38. Although FIG. 2 illustrates a spring within the tappet assembly 34, a spring is not required within the embodiments of the present invention.

As further illustrated in FIG. 2, a hydraulic piston 46 is positioned within the guide housing 40 and is coupled to the upper tappet body 36. During the closing phase 12 of the intake valve 18, the hydraulic piston 46 is supplied with a hydraulic fluid having a selective parameter, such as pressurized oil 48 having a selective pressure, for example, where the selective pressure is based on an operating parameter of the engine 20. Subsequent to supplying the hydraulic piston 46 with the pressurized oil 48, a duration of the relative oscillation between the upper tappet body 36 to the lower tappet body 38, and in-turn the duration of the closing phase 12 of the intake valve 18, are selectively varied. Although two hydraulic pistons are illustrated in FIG. 2, less or more than two hydraulic pistons may be utilized within the embodiments of the system, for example. Additionally, although pressurized oil is discussed as an example of a hydraulic fluid, any type of hydraulic fluid may be supplied to the hydraulic piston, in the embodiments of the present invention.

The system 10 includes an oil pressure regulator 54, which supplies pressurized oil at a selective pressure to the hydraulic piston 46. Additionally, a controller 56 is coupled to the oil pressure regulator 54, and selectively adjusts the pressure of the oil supplied from the oil pressure regulator 54 to the hydraulic piston 46, based on the operating parameter of the engine 20, such as the speed and/or load of the engine, for example. The oil pressure regulator 54 may supply pressurized oil 48 from an existing pressurized oil supply of the engine 20, and thus the controller 56 may regulate the pressure of the pressurized oil 48, based on a pre-existing pressure range of the existing pressurized oil supply, for example. The controller 56 includes a memory 58, which stores a predetermined pressure based on a respective operating parameter of the engine 20. The predetermined pressure is selected such that, subsequent to supplying the oil at the predetermined pressure to the hydraulic piston 46, a predetermined duration of the closing phase of the intake valve 18 will result, such that a performance characteristic of the engine (e.g., fuel efficiency, emissions, or the like) is enhanced. Thus, for each respective operating parameter of the engine 20, a predetermined duration of the closing phase of the intake valve 18 is realized, such that the intake valve 18 is closed at the appropriate time of the engine 20 cycle, in order to enhance a performance characteristic of the engine 20. In an exemplary embodiment, the duration of the closing phase of the intake valve 18 is determined relative to an elapsed duration 50 (FIG. 3 below) for the piston 22 to oscillate to the bottom portion 30 of the cylinder 26 (also known as "bottom dead center" or "BDC"). For example, for a high speed or high load parameter of the engine 20, the duration of the closing phase 12, to enhance a performance characteristic of the engine 20, may end prior to bottom dead center, and thus the intake valve 18 would close prior to the piston 22 reaching the bottom portion 30 of the cylinder 26. In another example, for a low speed or low load parameter of the engine 20, the duration of the closing phase 12, to enhance a performance characteristic of the engine 20, may end subsequent to bottom dead center, and thus the intake valve 18 would close after the piston 22 reaches the bottom portion 30 of the cylinder 26.

Figure 3:
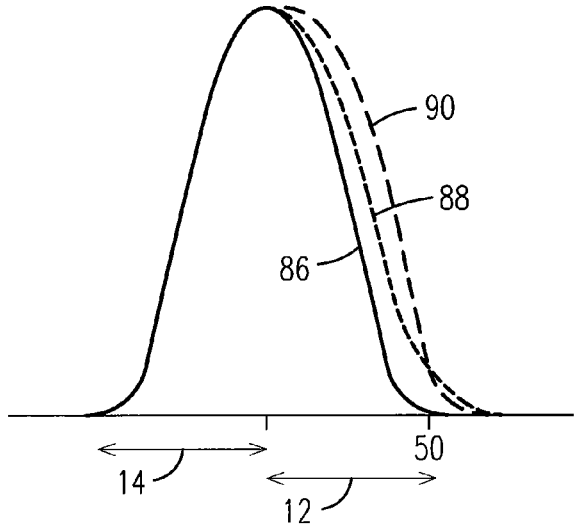
FIG. 3 is a plot of an exemplary embodiment of a spacing of the opening versus time during the opening phase and the closing phase of the intake valve illustrated in FIG. 1.

FIG. 3 illustrates a plot of the size of the opening of the intake valve 18 versus time, for various engine parameters. All three curves 86,88,90 have the same approximate duration of the opening phase 14. However, the first curve 86 illustrates an example for exclusively high load/speed engine parameters, in which the duration of the closing phase 12 terminates prior to the duration 50 required to reach bottom dead center. Additionally, the third curve 90 illustrates an example for exclusively low load/speed engine parameters, in which the duration of the closing phase 12 extends beyond the duration 50 required to reach bottom dead center. The second curve 88 demonstrates the embodiments of the present invention, in which the duration of the closing phase 12 may be selectively adjusted based on the engine parameter. The second curve 88 approaches the first curve 86 (i.e., high load/speed conditions) prior to the duration 50 to reach BDC, but also approaches the third curve 90 (i.e., low speed/load conditions) subsequent to the duration 50 to reach BDC, and thus can selectively accommodate a range of duration of closing phases 12, based on the varying engine parameters.

Figure 4:
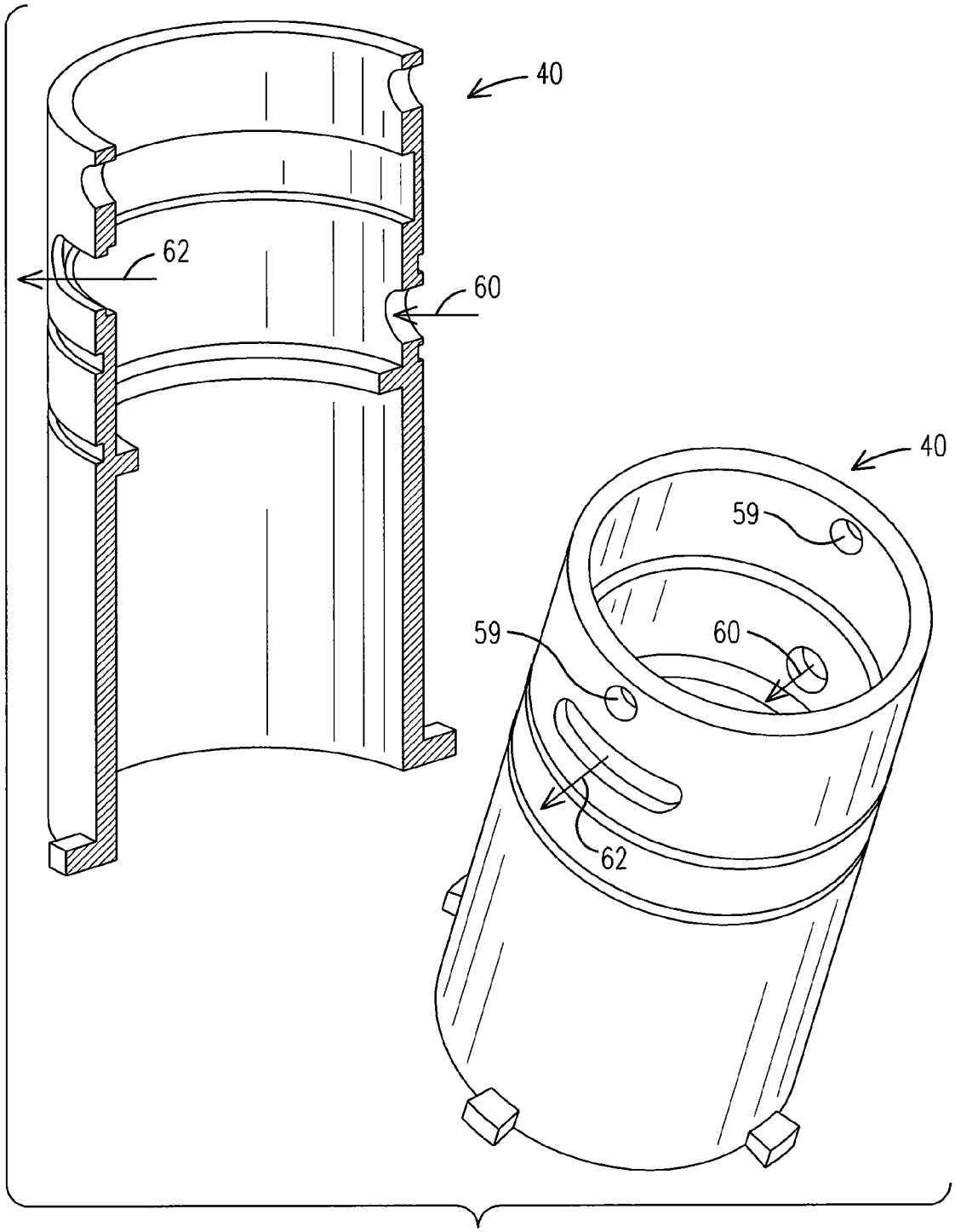
FIG. 4 is a perspective view and a cross-sectional view of an exemplary embodiment of a guide housing within the system illustrated in FIG. 2.

FIG. 4 illustrates a guide housing 40 in accordance with an embodiment of the present invention. As illustrated in FIG. 4, the guide housing 40 takes a cylindrical form. The pressurized oil 48 is supplied from the oil pressure regulator 54 through an input 60 (FIG. 4) of the guide housing 40, and to the hydraulic piston 46 (FIG. 2). Additionally, toward the end of the closing phase 12, the hydraulic piston 46 lowers within the guide housing 40, and the pressurized oil 48 exits from an output 62 of the guide housing. The input 60 through which the pressurized oil 48 enters the guide housing 40 is lower than the output 62 through which the pressurized oil 48 exits the guide housing 40, as the pressurized oil 48 rises within the guide housing 40 along with the hydraulic piston 46 during the closing phase 12. A bolt hole 59 is positioned along a top portion of the guide housing 40, and a bolt 57 (FIG. 10) is passed through the bolt hole 59, to secure the guide housing 40 within the block 35. In an exemplary embodiment, the inner diameter of the guide housing measures 58 millimeters, for example, and the height of the guide housing measures 120 millimeters, for example.

Figure 5:
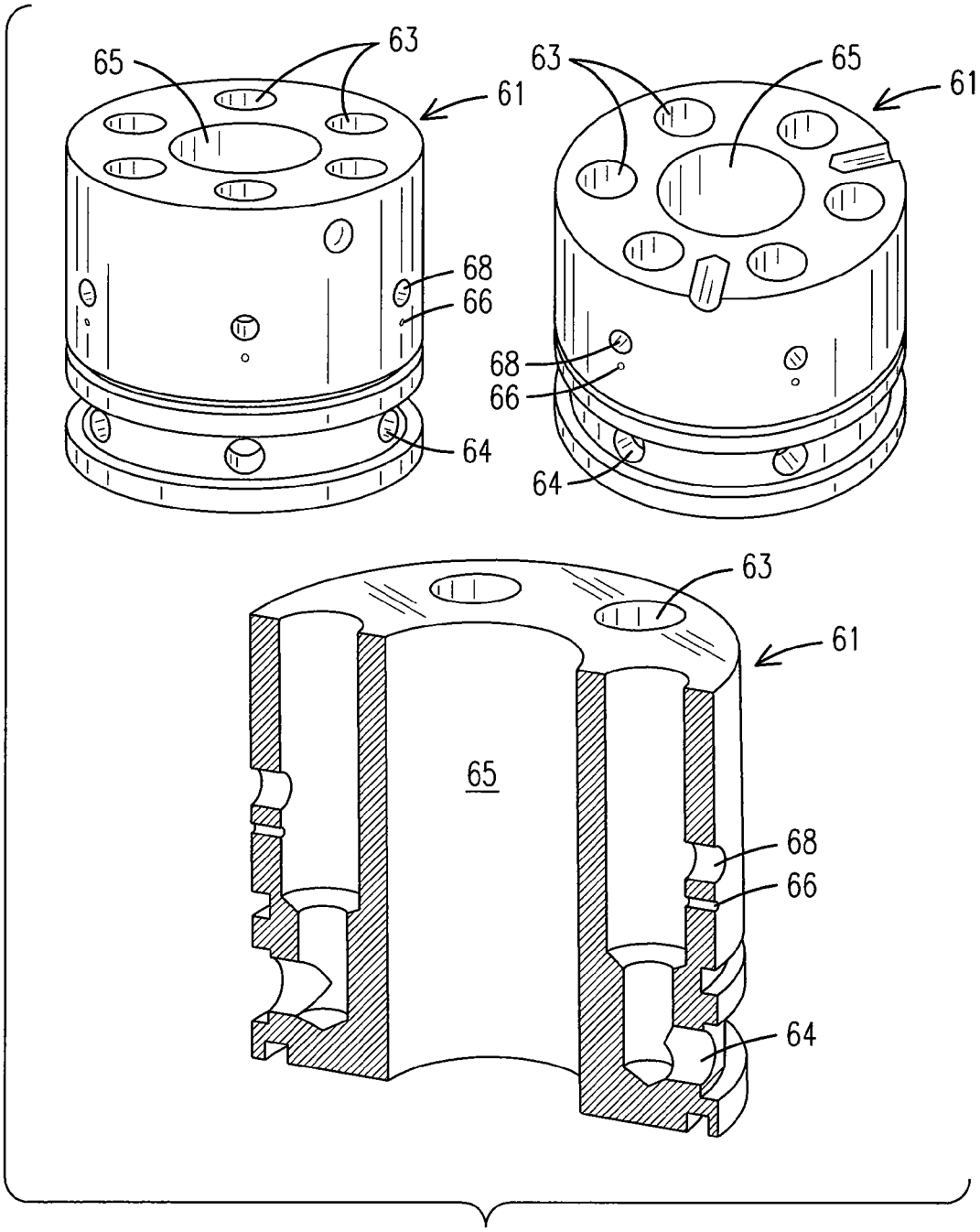
FIG. 5 is a perspective view and a cross-sectional view of an exemplary embodiment of a cylindrical unit within the system illustrated in FIG. 2.
Figure 10:
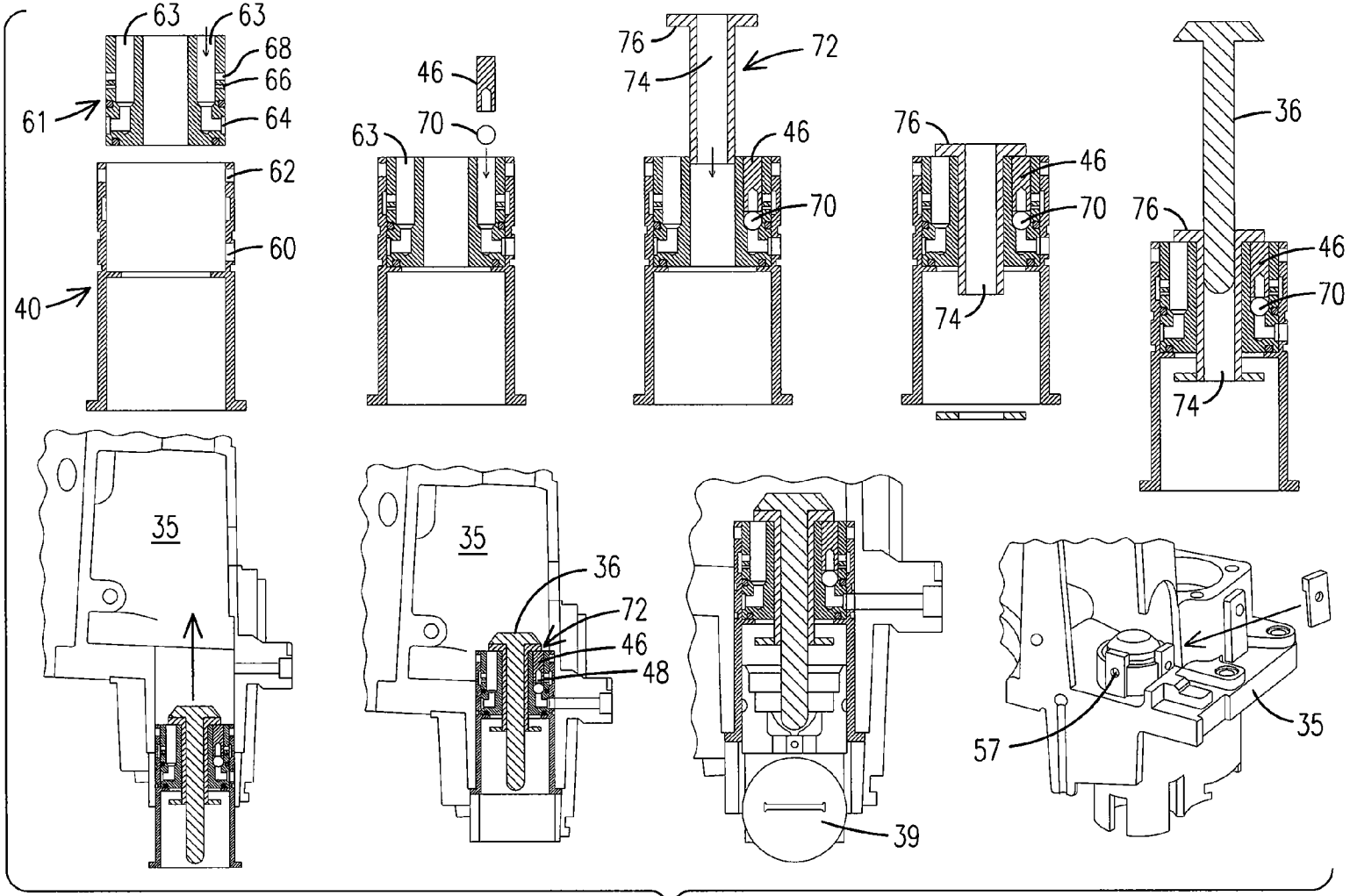
FIG. 10 is a cross-sectional side view of an exemplary embodiment of a method for assembling the system illustrated in FIG. 2.

FIG. 5 illustrates a cylindrical unit 61 in accordance with an embodiment of the present invention. The cylindrical unit 61 is configured to receive a plurality of hydraulic pistons 46 in a respective slot 63. Although FIG. 5 illustrates a cylindrical unit 61 configured to hold six hydraulic pistons, the cylindrical unit may be configured to hold more or less than six hydraulic pistons, for example. The slots 63 are concentrically positioned about an opening 65 through which a cylindrical sleeve 72 and upper tappet body 36 are passed (FIG. 10). However, the slots 63 need not be concentrically positioned about the opening 65. The cylindrical unit 61 is received within the guide housing 40. (See FIG. 2.) The pressurized oil 48 from the oil pressure regulator 54 passes through the input 60 of the guide housing 40 and an inlet 64 of the cylindrical unit 61, which is aligned with the input 60 of the guide housing 40. Additionally, during the closing phase 12, after the pressurized oil 48 raises the hydraulic piston 46 within the slot 63, the pressurized oil 48 exits through one or more outlets 66,68 of the cylindrical unit 61 and the output 62 of the guide housing 40, which is aligned with the outlets 66,68 of the cylindrical unit 61. The outlets 66,68 of the cylindrical unit 61 have varying size (or "bleed size"), such as a small outlet 66 and a larger outlet 68. In an exemplary embodiment, the hydraulic pistons have a diameter of approximately 10 millimeters and a length of 22 millimeters, which provides a stroke of 12 millimeters. In an exemplary embodiment, the outlets of the cylindrical unit measure 4 millimeters (larger outlet) and 1 millimeter (smaller outlet) in diameter. In an exemplary embodiment, the inlet of the cylindrical unit measures 6 millimeters in diameter. In an exemplary embodiment, the material used to construct the cylindrical unit may be 42CrMo4V, for example. In an exemplary embodiment, the time for actuation of the hydraulic piston (while the engine piston 22 travels from the bottom portion 30 to the top portion 28 of the cylinder 26, or from bottom dead center "BDC" to top dead center "TDC") is approximately 0.04058 seconds, for example.

Figure 6:
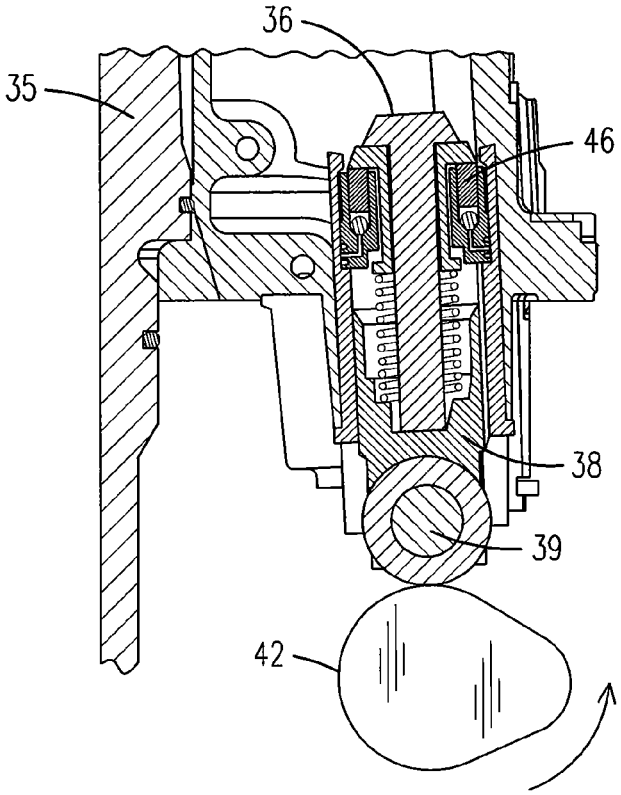
FIG. 6 is a cross-sectional side view of an exemplary embodiment of the system illustrated in FIG. 2 prior to an opening phase of the intake valve.
Figure 7:
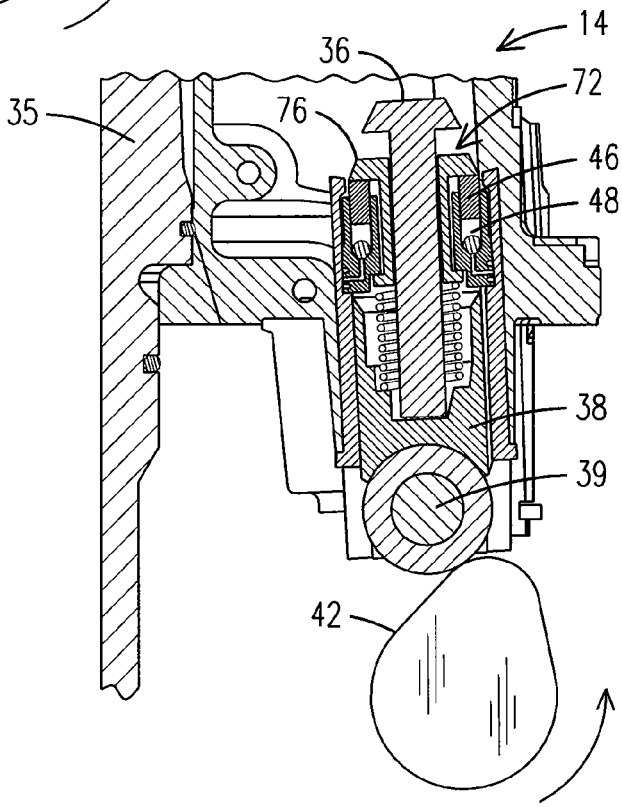
FIG. 7 is a cross-sectional side view of an exemplary embodiment of the system illustrated in FIG. 2 during an opening phase of the intake valve.
Figure 8:
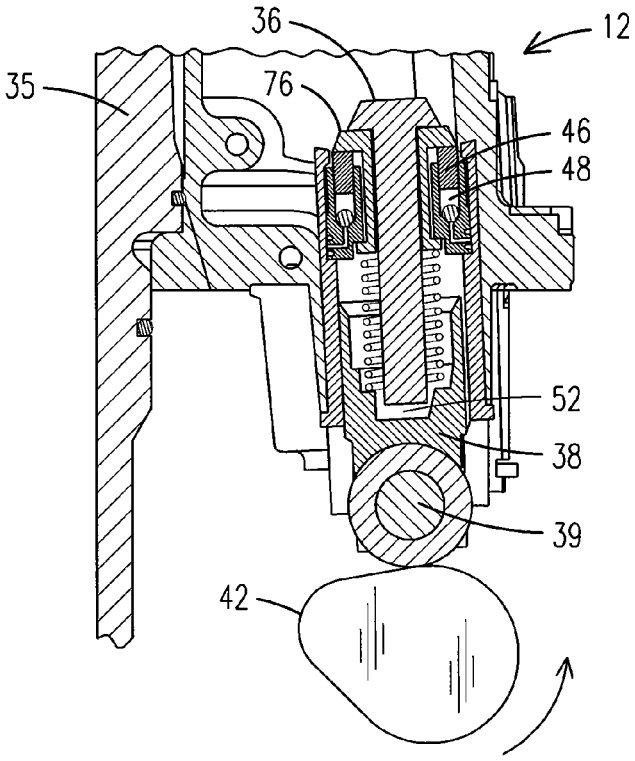
FIG. 8 is a cross-sectional side view of an exemplary embodiment of the system illustrated in FIG. 2 during a closing phase of the intake valve.
Figure 9:
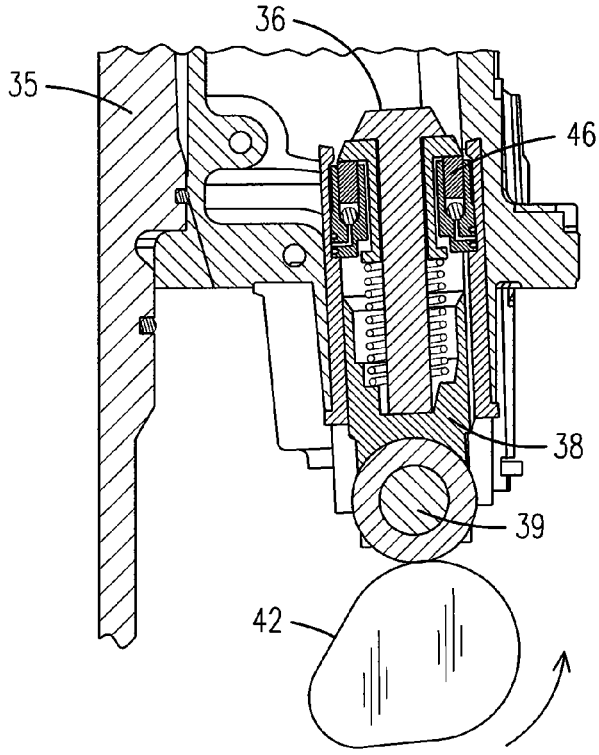
FIG. 9 is a cross-sectional side view of an exemplary embodiment of the system illustrated in FIG. 2 subsequent to a closing phase of the intake valve.

FIGS. 6-9 illustrate sequential stages of the tappet assembly 34 during an opening phase 14 and a closing phase 12 of the intake valve 18. As illustrated in FIG. 6, the intake valve 18 (not shown) is closed, and the cam 42 has not yet engaged the cam roller 39, which causes the relative oscillation between the upper tappet body 36 and the lower tappet body 38. FIG. 7 illustrates a stage during the opening phase 14 of the intake valve 18, where the cam 42 has engaged (counterclockwise rotation) the cam roller 39, which in-turn causes an initiation of the relative oscillation between the upper tappet body 36 and the lower tappet body 38. In FIG. 7, the upper tappet body 36 has oscillated relative to the lower tappet body 38 such that the upper tappet body 36 extends above and is no longer in contact with a top flange portion 76 of a cylindrical sleeve 72 (discussed below). FIG. 8 illustrates a stage during the closing phase 12 of the intake valve 18, after the opening caused by the intake valve 18 to the cylinder 26 has begun to close. During this portion of the closing phase 12 illustrated in FIG. 8, the hydraulic piston 46 is supplied with the pressurized oil 48 from the oil pressure regulator 54. The pressurized hydraulic piston 46 in-turn affects the relative oscillation between the upper tappet body 36 and the lower tappet body 38, as it delays a lowering of the upper tappet body 36 relative to the lower tappet body 38 (from FIG. 7), and introduces a gap 52 between the upper tappet body 36 and the lower tappet body 38. The introduction of the gap 52 extends the duration of the closing phase 12 beyond the "bottom dead center" duration 50 (FIG. 3) for the piston 22 to reach the bottom portion 30 of the cylinder 26. After the pressurized oil 48 has passed through the input 60 and inlet 62, the pressurized oil 48 exits from the slot 63 during the closing phase 12 through one or more of the outlets 66,68, at a rate based on the dimension of the outlet(s). The duration of the closing phase 12 is based on the dimension of the outlet(s) 66,68, the selective pressure of the pressurized oil 48 (adjusted by the controller 56 and the oil pressure regulator 54), a number of hydraulic pistons 46 within the tappet assembly 34, and/or a volume of pressurized oil 48 supplied into the respective slots 63. As illustrated in FIG. 9, the cam 42 continues to rotate counterclockwise, out of rotatable engagement with the cam roller 39, the gap 52 closes up, and thus the closing phase 12 ends, causing the opening between the intake valve 18 and the cylinder 26 to close.

In an exemplary embodiment, a dimension of one or more of the input 60, output 62, inlet 64 and/or outlets 66,68, may be selectively varied during a design phase, to selectively vary the duration of the relative oscillation of the upper tappet body 36 and the lower tappet body 38, and selectively vary the duration of the closing phase 12.

FIG. 10 illustrates a sequence of steps for a method of assembling a tappet assembly 34 in accordance with the present invention. The cylindrical unit 61 is initially positioned within the guide housing 40, such that the input 60 of the guide housing 40 is aligned with the inlet 64 of the cylindrical unit 61, and the output 62 of the guide housing 40 is aligned with the outlets 66,68 of the cylindrical unit 61, when the upper tappet body 36 is raised during the closing phase 12 (FIG. 7). One or more hydraulic pistons 46 are subsequently inserted into the respective slots 63 of the cylindrical unit 61, with a check valve 70, such as a spherical valve, for example, being positioned between the base of the hydraulic piston 46 and the inlet 64. Subsequent to supplying the hydraulic piston 46 with the pressurized oil 48 through the inlet 64, the pressurized oil 48 passes above the check valve 70 and presses against the base of the hydraulic piston 46. The check valve 70 prevents the pressurized oil 48 above the check valve 70 from passing below the check valve 70 and exiting out the slot 63 back through the inlet 64. After the hydraulic piston(s) 46 and check valves 70 are positioned within the slots 63, a cylindrical sleeve 72 is passed through an opening 65 of the cylindrical unit 61. A top flange portion 76 of the cylindrical sleeve 72 makes contact with a top portion of the hydraulic piston 46. The upper tappet body 36 is subsequently passed through an opening 74 in the cylindrical sleeve, and makes contact with an opposite side of the top flange portion 76 from the hydraulic piston 46. The tappet assembly 34 is subsequently passed into a slot within the block 35, and a cam roller 39 is attached to the lower tappet body 38. One or more bolts 57 are passed through the bolt holes 59 (FIG. 4) of the guide housing 40, to secure the tappet assembly within the slot of the block 35. In an exemplary embodiment, the check valve is a spherical ball, which has a diameter of 8 millimeters, for example.

Figure 11:
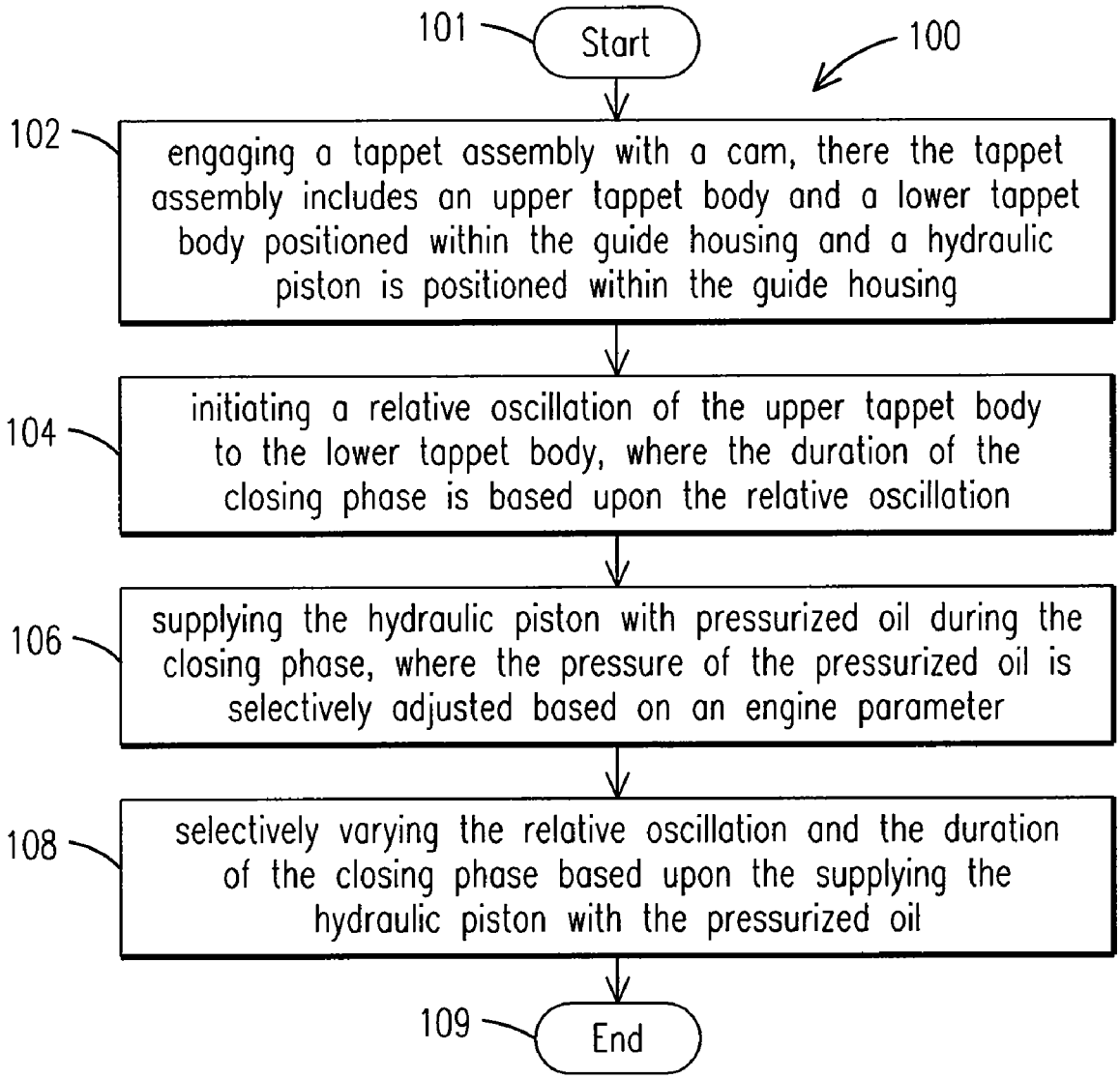
FIG. 11 is a flow chart illustrating an exemplary embodiment of a method for varying a duration of a closing phase of an intake valve of an engine.

FIG. 11 illustrates a flowchart depicting a method 100 for varying the duration of the closing phase 12 of the intake valve 18 of the engine 20, in accordance with the present invention. The method 100 begins at 101 by engaging 102 a tappet assembly 34 with a cam 42, where the tappet assembly includes an upper tappet body 36 and a lower tappet body 38 positioned within the guide housing 40 and a hydraulic piston 46 is positioned within the guide housing. The method 100 further includes initiating 104 a relative oscillation of the upper tappet body 36 to the lower tappet body 38, where the duration of the closing phase 12 is based upon the relative oscillation. The method 100 further includes supplying 106 the hydraulic piston 46 with pressurized oil 48 during the closing phase 12, where the pressure of the pressurized oil 48 is selectively adjusted based on an engine parameter. The method 100 further includes selectively varying 108 the relative oscillation and the duration of the closing phase 12 based upon the supplying 110 the hydraulic piston 46 with the pressurized oil 48, before ending at 109. Another embodiment relates to a method for controlling an intake valve of an engine. As above, the engine comprises the intake valve and an engine piston that is configured to oscillate within a cylinder from a top portion to a bottom portion. The intake valve is positioned adjacent to the cylinder, and is configured to oscillate between an opening phase and a closing phase. In this embodiment, the method comprises engaging a tappet assembly with a cam to initiate relative oscillation of a first tappet body to a second tappet body. The tappet assembly is operably connected to the intake valve, so that a duration of the intake valve closing phase is based upon the relative oscillation of the first and second tappet bodies. (As should be appreciated, the tappet assembly comprises a guide housing and the first tappet body and the second tappet body positioned within the guide housing.) The method further comprises, during the closing phase, supplying a hydraulic fluid to a hydraulic piston positioned within the guide housing, wherein a rate of the relative oscillation, and thereby the duration of the closing phase, is a function of a parameter of the hydraulic fluid (e.g., pressure, viscosity).

To summarize the structure and operation of one embodiment of the tappet assembly 34, with reference to FIGS. 2 and 6-9, the tappet assembly 34 comprises a guide housing 40, a cam roller 39, a cam 42, a lower tappet body 38, an upper tappet body 36, and a cylindrical unit 61. The guide housing 40 is cylindrical (or at least has a cylindrical longitudinal inner bore), and is non-movably attached to the engine block 35. For example, the guide housing 40 may be received in a bore, bracket, aperture, or the like in the engine block. The lower tappet body 38 is slidably received within and positioned towards the bottom or lower end of the guide housing 40. The cam roller 39 is attached to the bottom of the lower tappet body 38, and is operably engaged with the cam 42. In particular, when the cam 42 is rotated as shown in FIGS. 6-9, the cam roller 39 tracks along the cam 42, causing the lower tappet body 38 to slide up and down in the guide housing 40. The cylindrical unit 61 is non-movably disposed within the guide housing 40, and is positioned towards the top or upper end of the guide housing 40, above the lower tappet body 38. The cylindrical unit 61 includes one or more hydraulic pistons 46, each of which is disposed in a respective corresponding-shape slot 63 formed in the cylindrical unit body. Each hydraulic piston 46 has a longitudinal (long) axis oriented parallel to the longitudinal axis of the tappet assembly. The hydraulic pistons extend out and past a top surface of the cylindrical unit 61, in a direction away from the lower tappet body 38. A cylindrical sleeve 72 is slidably positioned within a central longitudinal bore formed in the cylindrical unit 61. The cylindrical sleeve 72 includes a top flange 76, which engages and rests against the top ends of the hydraulic pistons 46, and a bottom flange having a diameter large enough to abut or engage the lower, bottom surface of the cylindrical unit. The distance between the top and bottom flanges of the cylindrical sleeve 72 allows the sleeve 72 to move up and down a designated distance with respect to the cylindrical unit, i.e., the range of sliding movement of the sleeve 72 is limited by the top and bottom flanges coming into abutting engagement with the top and bottom surfaces of the cylindrical unit 61, respectively. The upper tappet body 36 is an elongate member having a shaft-like body with upper and lower ends, and a flange-like head attached to the upper end of the body. The upper tappet body 36 is slidingly positioned within a central longitudinal bore formed in the sleeve 72; thereby, the upper tappet body 36, sleeve 72, cylindrical unit 61, and housing 40 are concentrically arranged.

In operation, in this embodiment, as the cam 42 moves counterclockwise (from the perspective of FIG. 6), this pushes the cam roller 42 and lower tappet body 38 upwards in the guide housing 40. The inner top surface of the lower tappet body 38 engages the lower end of the upper tappet body 36, forcing it upwards and the top head portion of the upper tappet body 36 away from the top flange 76 of the sleeve 72. (See FIG. 7.) Upwards movement of the upper tappet body 36 in this manner actuates the valve train (e.g., pushrod 23), as shown in FIG. 2. As the lobe portion of the cam 42 moves out of engagement with the cam roller 39 (FIG. 8), this allows the lower tappet body 38 to slide downwards in the guide housing 40. The upper tappet body 36 also moves downwards (due to a spring force supplied by the push rod 23 from the rocker lever), but eventually the top head portion of the upper tappet body 36 encounters the top flange 76 of the sleeve 72. In an exemplary embodiment, although the upper tappet body 36 is not attached to the pushrod 23, it maintains contact until the intake valve 18 closes in which case there is a gap 52 introduced between the upper tappet body 36 and the lower tappet body 38. Further downwards movement of the upper tappet body 36 is governed by the hydraulic pistons 46 (and the spring 37, if used), and more particularly by a parameter of a hydraulic fluid supplied to the hydraulic pistons. For example, if the hydraulic fluid is supplied at a high pressure, the rate/time of downwards movement of the upper tappet body is reduced (e.g., the hydraulic pistons are harder to push downwards) versus the case where the hydraulic fluid is supplied at a lower pressure. This arrangement results in relative oscillation between the lower and upper tappet bodies, as controlled by the hydraulic fluid supplied to the hydraulic pistons 46.

Although certain embodiments are described herein with respect to oil, e.g., the oil pressure regulator 54, other embodiments of the invention are not limited in this regard, and hydraulic fluids other than oil may be used instead. Thus, for any references or description specifying oil above, the stated element or feature is applicable to hydraulic fluids generally. For example, the oil pressure regulator 54 is more generally characterized as a hydraulic fluid pressure regulator, the pressurized oil 48 as pressurized hydraulic fluid, and the like. Also, the controller 56 and memory 58 may be configured with data specific to a particular type of hydraulic fluid used in the system, if something other than oil.

As used herein, the term "piston" refers to any member slidably moveable within a receiving bore/aperture and that is configured for driving interaction with a working fluid (e.g., hydraulic fluid). For example, the piston may be moved by expansion of a working fluid acting upon the piston, or movement of the piston by an external force may be modified or controlled by a working fluid acting upon the piston in conjunction with the receiving bore/aperture.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A system, comprising:

a tappet assembly coupled to an intake valve of an engine, said tappet assembly including a first tappet body and a second tappet body within a guide housing, wherein an oscillation of the intake valve between an opening phase and a closing phase of the intake valve is based on a relative oscillation of said first tappet body and said second tappet body within the guide housing;

a cam coupled to a shaft of the engine, said cam being engaged with said tappet assembly to initiate the relative oscillation of said first tappet body to said second tappet body;

a hydraulic piston positioned within the guide housing and coupled to said first tappet body for selectively varying a duration of the relative oscillation of the first tappet body to the second tappet body based upon a parameter of a hydraulic fluid supplied to the hydraulic piston, to thereby selectively vary the duration of the closing phase of the intake valve;

a hydraulic fluid pressure regulator to supply pressurized hydraulic fluid to the hydraulic piston at a selective pressure; and a controller coupled to the hydraulic fluid pressure regulator, wherein said controller is configured to selectively adjust the pressure of the hydraulic fluid supplied from the hydraulic fluid pressure regulator to the hydraulic piston, based on at least one of a speed and/or load of the engine.

2. The system of claim 1, wherein said controller includes a memory configured to store a predetermined pressure based on a respective speed and/or load of the engine; said predetermined pressure is based on a predetermined duration of the closing phase for the respective speed and/or load of the engine, subsequent to the hydraulic fluid having the predetermined pressure being supplied to the hydraulic piston; wherein a performance characteristic of the engine is enhanced upon said intake valve having said predetermined duration of the closing phase.

3. A system comprising:

a tappet assembly coupled to an intake valve of an engine, said tappet assembly including a first tappet body and a second tappet body within a cylindrical guide housing, wherein an oscillation of the intake valve between an opening phase and a closing phase of the intake valve is based on a relative oscillation of said first tappet body and said second tappet body within the guide housing;

a cam coupled to a shaft of the engine, said cam being engaged with said tappet assembly to initiate the relative oscillation of said first tappet body to said second tappet body; and a hydraulic piston positioned within the guide housing and coupled to said first tappet body for selectively varying a duration of the relative oscillation of the first tappet body to the second tappet body based upon a parameter of a hydraulic fluid supplied to the hydraulic piston, to thereby selectively vary the duration of the closing phase of the intake valve;

a plurality of hydraulic pistons positioned within the guide housing;

said guide housing having a respective input and a respective output adjacent each hydraulic piston positioned within the guide housing, said output being above said input; and a cylindrical unit configured to receive the plurality of hydraulic pistons within a plurality of respective slots, said cylindrical unit is configured to be received within the guide housing and includes a respective inlet aligned with the respective input and a respective outlet aligned with the respective output for each hydraulic piston within the cylindrical unit.

4. The system of claim 3, wherein said duration of the relative oscillation and duration of the closing phase may be varied by a selective variation of a dimension of at least one of the respective input and output of the guide housing and/or the respective inlet and outlet of the cylindrical unit.

5. The system of claim 3, further comprising a respective check valve positioned within the respective slot between said respective inlet and respective outlet; wherein subsequent to said hydraulic fluid being supplied through said respective input and said respective inlet into a respective slot, said hydraulic fluid passes above said respective check valve and against said hydraulic piston; and wherein said respective check valve is configured to prevent said hydraulic fluid above said respective check valve from passing below said respective check valve and exiting said respective slot through said inlet.

6. The system of claim 3, further comprising a cylindrical sleeve having an opening through which the first tappet body is passed within the guide housing; wherein said plurality of hydraulic pistons are configured to engage a top flange portion of the cylindrical sleeve, said top flange portion being in contact with said first tappet body during the closing phase.

7. The system of claim 3, wherein upon said hydraulic fluid having passed through said respective input and respective inlet, said hydraulic fluid is configured to exit from said slot during the closing phase through said outlet at a rate based on a dimension of said outlet; and wherein said duration of the closing phase is based on at least one of the dimension of said outlet, the selective parameter of the hydraulic fluid, a quantity of the plurality of hydraulic pistons, and/or a volume of hydraulic fluid supplied into the respective slot.

8. A method for varying a duration of a closing phase of an intake valve of an engine, comprising:

engaging a tappet assembly with a cam, said tappet assembly comprising a first tappet body and a second tappet body positioned within a guide housing and a hydraulic piston positioned within the guide housing;

initiating a relative oscillation of said first tappet body to said second tappet body, said duration of the closing phase based upon said relative oscillation;

supplying said hydraulic piston with a hydraulic fluid during the closing phase, said hydraulic fluid having a selective parameter based on a parameter of the engine;

selectively varying the relative oscillation and the duration of the closing phase based upon said supplying the hydraulic piston with the hydraulic fluid;

regulating a pressure of hydraulic fluid supplied to the hydraulic piston; and selectively adjusting the pressure of the hydraulic fluid supplied to the hydraulic piston, based on at least one of a speed and/or load of the engine.

9. The method of claim 8, further comprising storing a predetermined pressure based on a respective speed and/or load of the engine;

wherein said predetermined pressure is based on a predetermined duration of the closing phase for the respective speed and/or load of the engine, subsequent to the hydraulic fluid having the predetermined pressure being supplied, to the hydraulic piston; wherein a performance characteristic of the engine is enhanced upon said intake valve having said predetermined duration of the closing phase.

10. A method for varying a duration of a closing phase of an intake valve of an engine, comprising:

engaging a tappet assembly with a cam, said tappet assembly comprising a first tappet body and a second tappet body positioned within a cylindrical guide housing, a cylindrical unit received within the guide housing, and a plurality of hydraulic pistons received within a plurality of respective slots of the cylindrical unit, wherein the guide housing defines an output and an input, said output being above said input, and wherein the input and output are respectively aligned with inlets and outlets of the hydraulic pistons within the cylindrical unit;

initiating a relative oscillation of said first tappet body to said second tappet body, said duration of the closing phase based upon said relative oscillation;

supplying said hydraulic pistons with a hydraulic fluid during the closing phase, said hydraulic fluid having a selective parameter based on a parameter of the engine; and selectively varying the relative oscillation and the duration of the closing phase based upon said supplying the hydraulic pistons with the hydraulic fluid.

11. The method of claim 10, further comprising:

passing the first tappet body through an opening in a cylindrical sleeve; and engaging said plurality of hydraulic pistons with a top flange portion of the cylindrical sleeve, said top flange portion being in contact with said first tappet body during the closing phase.

* * * * *